US012808373B2

(12) United States Patent
Ladig et al.

(10) Patent No.: US 12,808,373 B2
(45) Date of Patent: Nov. 24, 2026

(54) MULTIPHASE PUMPING SYSTEM WITH VERTICALLY MOUNTED DISCHARGE CHAMBER

(71) Applicant: CIRCOR PUMPS NORTH AMERICA, LLC., Monroe, NC (US)

(72) Inventors: Stefan Ladig, Monroe, NC (US); Axel Richard Jaeschke, Monroe, NC (US)

(73) Assignee: CIRCOR PUMPS NORTH AMERICA, LLC., Monroe, NC (US)

( * ) Notice: Subject to any disclaimer, the term of this patent is extended or adjusted under 35 U.S.C. 154(b) by 0 days.

(21) Appl. No.: 19/100,999

(22) PCT Filed: Aug. 1, 2023

(86) PCT No.: PCT/US2023/029169
§ 371 (c)(1),
(2) Date: Feb. 4, 2025

(87) PCT Pub. No.: WO2024/039524
PCT Pub. Date: Feb. 22, 2024

(65) Prior Publication Data

US 2026/0043401 A1 Feb. 12, 2026

Related U.S. Application Data

(60) Provisional application No. 63/398,614, filed on Aug. 17, 2022.

(51) Int. Cl.
*F04C 2/16* (2006.01)
*F04C 11/00* (2006.01)
(Continued)

(52) U.S. Cl.
CPC ..... *F04C 2/16* (2013.01); *F04C 2/165* (2013.01); *F04C 11/001* (2013.01); *F04C 13/00* (2013.01);
(Continued)

(58) Field of Classification Search
CPC ..... F04C 2/16; F04C 2/165; F04C 11/001; F04C 13/00; F04C 15/06; F04C 2240/30
See application file for complete search history.

(56) References Cited

U.S. PATENT DOCUMENTS 5,871,340 A * 2/1999 Hatton ..... F04C 2/16 417/406
6,457,950 B1 10/2002 Cooper
(Continued)

FOREIGN PATENT DOCUMENTS

DE 102017118971 A1 2/2019
GB 2227057 A 7/1990
(Continued)

OTHER PUBLICATIONS

German Patent Publication and Machine Translation for DE 10 2017 118 971 A1; 1st Inventor: Eschner; Title: Multiphase Pump With Separation Housing; Published: Feb. 21, 2019. (Year: 2019).*
(Continued)

*Primary Examiner* — Mary A Davis
(74) *Attorney, Agent, or Firm* — KDW FIRM PLLC

(57) ABSTRACT

A multiphase pump system includes a pump (10) having first and second screw rotors (4) disposed within a pump body (A), and at least one inlet (3) in fluid communication with the first and second screw rotors, respectively. A discharge casing (B) is coupled to the pump body (A) for receiving fluid discharged from the first and second screw rotors (4). The discharge casing (B) is oriented orthogonally or at a non-zero angle with respect to a longitudinal axis of the pump body (A). The discharge casing (B) includes a separation chamber for separating liquid and gas components of the fluid discharged from the first and second screw rotors (4). The pump body (A) includes at least one opening (9) for directing separated liquid from the discharge casing (B) to a discharge chamber of the pump body (A).

11 Claims, 6 Drawing Sheets

(51) Int. Cl.
*F04C 13/00* (2006.01)
*F04C 15/06* (2006.01)

(52) U.S. Cl.
CPC ..... *F04C 13/007* (2013.01); *F04C 15/06* (2013.01); *F04C 2210/24* (2013.01); *F04C 2220/20* (2013.01); *F04C 2240/30* (2013.01)

(56) References Cited

U.S. PATENT DOCUMENTS

| | | | |
|---|---|---|---|
| 10,344,580 | B2 | 7/2019 | Williams |
| 10,427,172 | B2 | 10/2019 | Altorf et al. |
| 2008/0199340 | A1 | 8/2008 | Rohlfing |
| 2020/0088201 | A1 | 3/2020 | Bourne |

FOREIGN PATENT DOCUMENTS

| | | | | |
|---|---|---|---|---|
| RU | 2164312 | C1 | 3/2001 | |
| WO | WO-9945272 | A1 * | 9/1999 | ..... F04C 15/008 |

OTHER PUBLICATIONS

Chinese Patent Publication and Machine Translation for CN 202628526 U; 1st Inventor: Zhou; Title: Vertical Screw Compressor Oil Separating System; Published: Nov. 18, 2011. (Year: 2011).*

International Search Report and Written Opinion for International Application No. PCT/US2023/029169, filing date Aug. 1, 2023, 7 pages.

International Preliminary Report on Patentability for International Application No. PCT/US2023/029169, filing date Aug. 1, 2023, 7 pages.

* cited by examiner

MULTIPHASE PUMPING SYSTEM WITH VERTICALLY MOUNTED DISCHARGE CHAMBER

CROSS-REFERENCE TO RELATED APPLICATIONS

This international patent application claims priority to U.S. provisional patent application Ser. No. 63/398,614, filed Aug. 17, 2022, the entirety of which is incorporated by reference herein.

FIELD OF THE DISCLOSURE

The present disclosure relates generally to a system for pumping multiphase fluids, and more particular to a pump casing design for use in pumping multiphase fluids.

BACKGROUND OF THE DISCLOSURE

Multiphase boosting is a process that combines liquid pumping and gas compression in a single machine. Twin-screw pumps have been used to advantage in such applications. A Multiphase Pump (MPP) must be able to handle a variety of process parameters when pumping multiphase fluids that can include gas contents ranging from 0% to 100%, with average volumetric gas content typically consisting of 50% to 95% gas. Pump capacities typically ranged from 30% to 100% of nominal capacity to adjust to changing well conditions and to handle field starts. Flow can vary over a wide range from just 10 $m^3$/hr to several 1000 $m^3$/hr of fluid mixture. Consequently, very large pumps with large casings are required. In addition, pump pressures (suction, discharge, differential) can vary in a very wide range (20% to 100% of design case) due to changing field conditions.

Wellhead-shut-in pressures can be very high and can exceed easily the normal operating conditions of the pump. As such, MPPs often need to be rated to match the piping pressure rating or to withstand the wellhead-shut-in pressure, even if the design operation pressure is much lower. These requirements can also apply to the pump suction, especially during pump start.

Overcoming the aforementioned challenges requires the implementation of a variety of design features. In some embodiments the pressure rating of the pump casing need to be 100 barg (600 #) or 150 barg (900 #) and a consequential test pressure of 1.5 times the pressure rating. Twin screw pumps can operate with up to 95% to 97% gas at the pump inlet. The pump needs this liquid to seal internal gaps between the screws and the liner in order to reduce the slip flow. Further, in most cases a fluid composition of from 3% to 5% liquid is sufficient to flush compression heat out of the screw chambers. Consequently, when 100% gas enters the pump an amount of liquid needs to be added to the incoming flow to address slip flow and heat removal issues. As will be appreciated, in multiphase boosting applications there is always the risk of slug flow and short periods of dry run (i.e., 100% gas).

Moreover, a MPP requires a certain liquid level at the outlet of the screws to provide sufficient liquid into the normal slip flow through the clearances between screws and screws and liner (i.e., internal backflow). One method for providing such liquid to the screw inlet and outlet is to install an oversized integrated discharge casing which acts as both a separator and a liquid reservoir. From this liquid reservoir a certain amount of liquid can be recirculated to the pump suction. Because the liquid reservoir is an integral part of the discharge casing the screws are always exposed to the liquid captured inside the discharge casing. Such an arrangement is shown in FIG. 1, illustrating a typical MPP "P". An enlarged pump casing "C" creates a volume for separation and storage of liquid apart from the gas component of the pumped fluid. Incoming flow (1) is lead to the screw inlet compartment and to the screw inlet(s) (3), from here the screws pump the fluid to the pump outlet compartment (4) which opens into the enlarged discharge casing (5). Some liquid will be separated inside the discharge chamber and the remaining fluids leaves the discharge casing "C" at its top position (2). The screw outlet ends are exposed to the discharge fluid retained in the discharge casing "C", and this fluid feeds the slip flow (8) through the screw gaps (i.e., the gaps between the screws and the liner). A portion of the fluid (typically 3 to 5%) is recirculated from the pump discharge, typically via an orifice (not shown) to the pump inlet (6). The recirculated fluid (7) is then combined with the incoming flow (3) inside the pump inlet casing.

Another solution that is often used in multiphase boosting is to install a liquid-gas separator upstream and/or downstream of the pump to collect as much liquid as possible and, from this liquid reservoir, feed a controlled amount of liquid to the pump inlet via a separate fluid line. This method, however, suffers from the disadvantage that it does not enable control of the liquid level at the screw outlets and consequently requires a higher rate of liquid fed into pump inlet. Consequently, the overall pump efficiency is reduced.

A combination of both of the aforementioned solutions is also possible in order to enable the MPP to operate for a longer time on 100% gas. However, at some point the pump system, including the collected amount of liquid, will heat up and lead to a pump shutdown. To extend the dry run time either the separation volume can be increase or the recirculated portion of the liquid can be cooled before being reinjected into the pump suction. This, of course, adds cost and complexity to the system. In addition, enlarging the separation volume may be required to support this liquid cooling function.

Storage of liquids requires tanks with sufficient volume to accommodate pump needs. Because the volume is integral to the pump and piping systems the tank needs to be rated for the full system pressure (e.g., 300 #, 600 #, 900 #), with higher pressures and larger volumes the tank becomes more complex and expensive. The diameter has a particularly significant impact on the thickness of the cylindrical tank wall and even more on the flat end-covers.

Separators and tanks external to the main pump body are less expensive but not as beneficial for the pumping process.

Integral tanks today require a large pump casing diameter (see, e.g., FIG. 1) as they are coaxially, radially enlarged pump discharge casings. Due to a given pump length, which is limited by the bearing span, the casings cannot easily be lengthened in the axial direction but only in radial direction (diameter). While this may be practical for low pressure pumps (up to 300 # or 50 bar), at higher pressures such arrangements become expensive and technically difficult to achieve, or they provide less storage volume and consequently cause reduced pump performance.

Conventional coaxial pressure casings are too expensive to be commercially attractive, especially on larger pumps. Pumping applications for fluids with high gas concentrations require enhanced separation, which means they require even larger casings, with attendant higher costs.

It would be advantageous to provide an improved multiphase pumping system that addresses the abovementioned issues.

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

The present disclosure combines the advantage of lower pump casing diameters, reduced complexity and cost and the same or better performance compared to a conventional integrated storage volume. The length of the discharge casing can be made independent of the main pump body length. As a result, the discharge casing can be made as long as desired to provide the pump with the optimal performance required for a given task.

A multiphase pump system is disclosed. The multiphase pump system can include a pump having at least one set of rotors disposed within a pump body, and at least one inlet in fluid communication with the first and second screw rotors, respectively. The system can further include a discharge casing coupled to the pump body for receiving fluid discharged from the first and second screw rotors. The discharge casing can include a longitudinal axis that is oriented at a non-zero angle with respect to a longitudinal axis of the pump body. The discharge casing can include a separation chamber that facilitates separation of liquid and gas components of the fluid discharged from the first and second screw rotors. The pump body includes at least one opening for directing separated liquid from the discharge casing to a discharge chamber of the pump body.

The multiphase pump system can include at least one orifice in the pump body to permit liquid to recirculate from the discharge casing to the at least one inlet. The multiphase pump system can further include at least one orifice in a pump liner portion of the pump body to permit liquid to recirculate from the discharge casing to the at least one inlet.

In some embodiments the discharge casing can partially or fully surround a portion of the pump body.

In some embodiments a central axis of the discharge casing is offset from a center of the pump body. In some embodiments the at least one inlet is positioned to provide inlet flow tangential to the at least one set of screw rotors. In some embodiments the at least one inlet comprises a plurality of inlets. In some embodiments the at least one set of rotors comprise a plurality of sets of rotors.

The multiphase pump system may further include a capacity reduction line disposed between the discharge casing and the pump body. The capacity reduction line can be configured to provide a flow of pressurized liquid from the discharge casing to an inlet chamber of the pump.

The multiphase pump system may further include a first isolation valve disposed in the capacity reduction line, and a second isolation valve disposed between the second pump inlet and the pump body.

In some embodiments a tubular separation element is disposed within the discharge casing. The tubular separation element can be positioned to receive discharge flow from the pump body and to direct the received flow into the discharge chamber. In some embodiments the tubular separation element includes at least one opening along a length of the tubular separation element for directing the received flow into the discharge chamber through the opening.

The multiphase pump system can include at least one guide vane for initiating a spin into the fluid for enhanced liquid separation.

The at least one set of rotors can be at least one set of screw rotors.

The longitudinal axis of the discharge casing can be oriented at an angle so that the longitudinal axis of the discharge casing forms an angle of from 30-degrees to 90-degrees with respect to longitudinal axis of the pump body.

In some embodiments the longitudinal axis of the discharge casing can be oriented at an angle so that the longitudinal axis of the discharge casing forms an angle of about 90-degrees with respect to longitudinal axis of the pump body.

BRIEF DESCRIPTION OF THE DRAWINGS

By way of example, a specific embodiment of the disclosed device will now be described, with reference to the accompanying drawings, in which.

Figure 1:
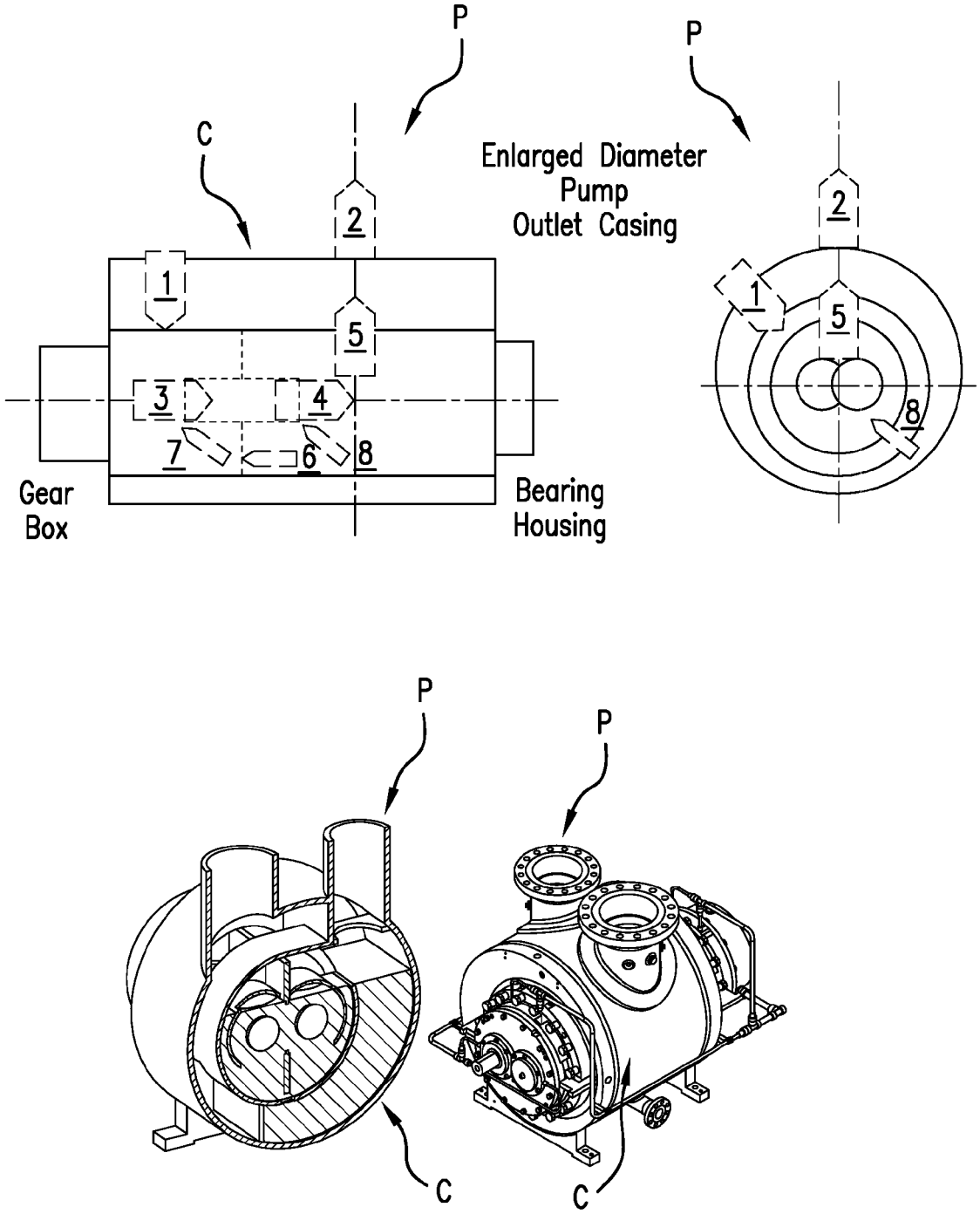
FIG. 1 (Prior Art)
FIG. 1 is a schematic of a conventional coaxial pump casing design.

The drawings are not necessarily to scale. The drawings are merely representations, not intended to portray specific parameters of the disclosure. The drawings are intended to depict example embodiments of the disclosure, and therefore are not to be considered as limiting in scope. In the drawings, like numbering represents like elements.

DETAILED DESCRIPTION

Numerous embodiments of an improved multiphase pumping system in accordance with the present disclosure will now be described more fully hereinafter with reference to the accompanying drawings, in which preferred embodiments of the present disclosure are presented. The systems of the present disclosure may, however, be embodied in many different forms and should not be construed as being limited to the embodiments set forth herein. Rather, these embodiments are provided so that this disclosure will convey certain example aspects of multiphase pumping systems to those skilled in the art. In the drawings, like numbers refer to like elements throughout unless otherwise noted.

As will be described in greater detail, the disclosed pumps include discharge casings that are not coaxial with the main pump body but rather are oriented orthogonal to the pump body and its associated rotors (screws). In some embodiments the discharge casing can be oriented at an angle so that the axis of the discharge casing forms an angle of from 30-degrees to 90-degrees with respect to the axis of the pump body and screws. As arranged, the disclosed can provide sufficient liquid to the screw inlets and screw outlets. In some embodiments the preferred orientation of the discharge casing is vertical (while the orientation of the pump body and screws is horizontal), but this is not critical and the discharge casing can be oriented at an angled (e.g., 30°, 45° or 60°) with respect to the pump body and screws. In some embodiments the discharge casing can be oriented in the horizontal plane of the pump body and screws.

It will be appreciated that in some embodiments the discharge casing can be oriented at an angle so that the axis of the discharge casing forms an angle of from 30-degrees to 90-degrees with respect to the axis of the pump body and screws. In some embodiments the pump main body can form one end of the extended discharge casing or the pump main body can be partly of fully integrated into the discharge casing.

In general, pumps according to the present disclosure will include one or more of the following aspects:

- Drain/Liquid distribution hole(s) at the lowest point of the discharge casing and the pump body.
- External drain and/or liquid distribution piping connecting all low points in the discharge casing to a single drain port.
- Recirculation orifices or internal liquid recirculation paths back to suction (3% recirculation for cooling) integrated into the liner disk(s)/wall(s) which separate the suction area from the discharge area.
- More than one recirculation orifice, which in some embodiments includes one recirculation orifice per pump side or one recirculation orifice per screw.
- Flow directed from each recirculation orifice to the mechanical seal area of the pump to spray recycled liquid towards the seals. In some embodiments the tubing can be coupled to the orifice to receive and direct such flow for flushing the seal area (e.g., API 682 seal Plan 11).
- External recirculation piping with built in recirculation orifice(s) between pump discharge(s) to pump inlet(s).
- One or more inlet nozzles disposed at different positions and sides of the pump suction compartment(s).
- One or more outlet nozzles disposed at different positions and sides of the pump discharge casing.
- Inlet nozzle(s) positioned tangential to the pump suction casing. Inlet nozzle(s) oriented in any of a variety of directions with respect to the pump's suction casing.
- Discharge nozzle(s) positioned tangential to the discharge casing.
- Discharge nozzle(s) disposed inside the discharge casing with a tube and elbow. The elbow can be oriented in any direction, one example direction being upwards to collect predominantly the gas, another example direction being horizontally to the side to initiate spinning (vortex) movement of the fluid inside the discharge casing.
- Discharge casing of the main-pump-body includes a device to improve fluid separation inside the discharge casing, a non-limiting example of which can be an extended cylindrical tube with one or more transverse bores, another non-limiting example of which can be to install guiding plates on the top outlet of the main body to the pump discharge casing to initiate a spin of the fluid inside the pump discharge casing. It will be appreciated that any type of separation aid can also be used.
- Additional valves on the discharge casing (tower) for example to install the pressure limiting valve (PLV) or pressure safety valve (PSV) device. The PLV/PSV flange can be installed below the liquid level inside the tower to thereby feed the PLV/PSV with liquid and to avoid PLV/PSV instabilities when feeding the PLV/PSV with undefined liquid-gas mixtures as typical for conventional installation of the PLV/PSV on the discharge piping.
- Capacity reduction without efficiency impact by connecting only one inlet to pump suction and to shut off the other inlet from suction but connecting it directly to pump discharge (liquid, mixture or gas phase). Such an arrangement can efficiently reduce pump capacity by 50% without efficiency losses. As such, one set of screws still pumps 50% of the design flow rate from inlet to discharge while the second screw-pair runs idle by simply moving fluid from discharge to discharge without building up pressure and without consuming energy.
- To simplify the use of the capacity reduction feature the pump can be equipped with a connection from pump discharge at an optimal position on the separation tower directly to the pump inlet chamber. A valve (manual or automated) can be integrated into this capacity reduction line.
- In combination with pump speed control, the capacity turn down ratio can be improved to 1:20 without reduction in pump efficiency. In some embodiments internal circulation on discharge level can be provided instead of external recirculation back to suction.
- Capacity reduction can be achieved with low gas or pure liquid pumps using a large, small, or no separation tower.
- A capacity reduction line can be provided internally (i.e., integrated) or externally (as shown in the figures).
- The disclosed pumps can be equipped with screws of the same dimension but different pitch to allow for more accurate performance adjustment of overall pump capacity.
- The disclosed pumps can be equipped with screws of different dimensions and diameters, and/or the same or different pitch.
- For capacity reduction operations the active screw-pair at the inlet defines the pump capacity. Where the pitch is larger compared to the second screw-pair the pump reduction is less than 50%. Where the pitch is smaller the capacity reduction is more than 50%. The disclosed pumps can be equipped with two capacity reduction lines, one for each pump inlet. In such case the capacity reduction can be 100% pump capacity, x % capacity, (1−x) % capacity. The difference in the screw pitch (p) can define x: $x=p\mathbf{1}/(p\mathbf{1}+p\mathbf{2})$.
- The capacity reduction concept can be applied on both sides of the disclosed pumps to allow for an unloaded start of the pump before first one side, and then the second side is opened to switch over to full capacity operation.
- The separator tower can also act as 3-phase separator, using different outlets to pull fluid from different separation levels.

DESCRIPTION OF THE DRAWINGS

The figures illustrate the different pump components and effects in a simplistic way. The pump can include one or more sets of screws, and one or more inlet or discharge compartments. The different inlet and outlet compartments within the pump casing can be connected to each other internally-inside the pump casing, externally-by specific piping, or the inlet and outlet compartments can remain separate from each other. In cases in which the inlet and outlet compartments remain separate from each other each compartment can includes its own inlet or outlet nozzle.

The figures show embodiments having one inlet compartment, one outlet compartment and one set of screws, but this is not limiting. Moreover, certain of the figures show a design variant with 2 inlet compartments, one central discharge compartment and two sets of screws.

Referring now to FIGS. 2A, 2B, 3A and 3B, a non-limiting example of a pump 10 according to the disclosure will be described. The pump 10 includes a main pump body A that includes the pump suction chamber(s) and the screw outlet compartment(s). An integrated pump discharge casing (B) is directly mechanically and fluidly connected to the screw outlet compartment so that it receives fluid from the screw outlet compartment. The pump discharge casing (B) can be connected to the screw outlet compartment using any appropriate technique, including welding, bolting, and the like. It will also be appreciated that the pump discharge casing can be integrally formed with the pump casing and/or screw outlet compartment. The pump discharge casing (B) has a longitudinal axis "B-B" that is oriented orthogonal to a longitudinal axis "A-A" of the pump body A. In some embodiments the longitudinal axis "B-B" of the discharge casing can be oriented at an angle so that the longitudinal axis "B-B" of the discharge casing forms an angle of from 30-degrees to 90-degrees with respect to longitudinal axis "A-A" of the pump body A.

As shown, incoming multiphase flow (1) is directed to the screw inlet (3), and is transported to the pump outlet casing by the screws (4). The flow moves from the pump outlet casing into the pump discharge casing (B) (shown by arrow (5)). Separation of liquid and gas components of the multiphase fluid occurs within the pump discharge casing (B). Liquid storage also takes place in the discharge casing (B).

Liquid is allowed to flow from the discharge casing (B) back into the pump discharge chamber of the main pump body (A) via one or more liquid balancing hole(s) (9) (best seen in FIG. 2B) formed in an upper portion of the main pump body (A). After capturing the liquid inside the pump discharge casing (B), the remaining flow (i.e., the gas component of the multiphase flow) leaves the pump casing at the upper part of the pump casing (in the direction of arrow (2)).

As will be appreciated, the disclosed arrangement exposes the screw outlet ends to the discharge fluid which feeds the slip flow (8) along the screw gaps (i.e., the gaps between the screws and the pump liner). A portion of the liquid (typically 3 to 5%) is recirculated from the pump discharge, for example via an orifice, to the pump inlet (6). The recirculated fluid (7) is combined with the incoming multiphase flow (3) inside the pump inlet casing.

Figure 2B:
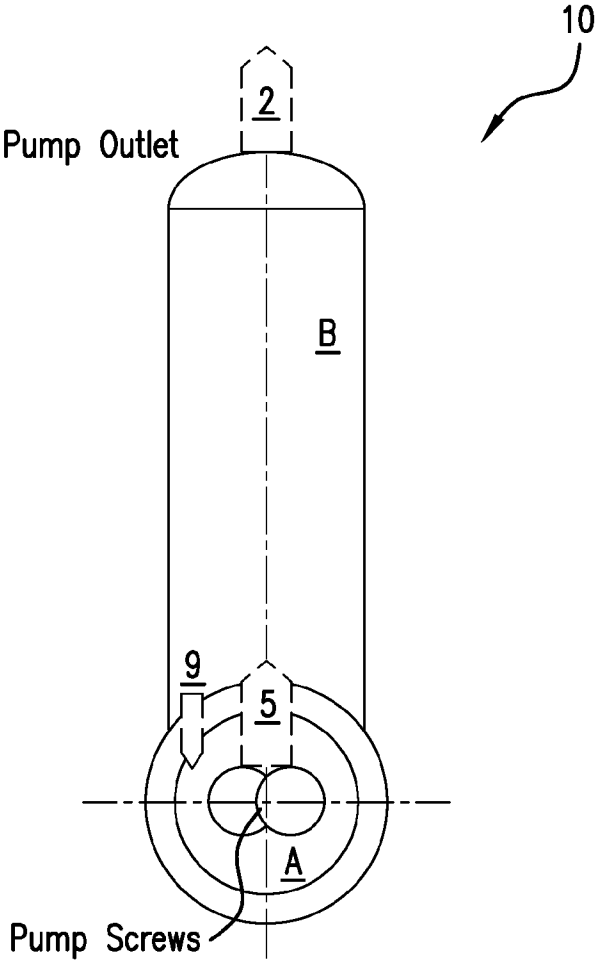
FIGS. 2A and 2B are side and end views of an example embodiment of a multiphase pump arrangement in accordance with the present disclosure.
Figure 2A:
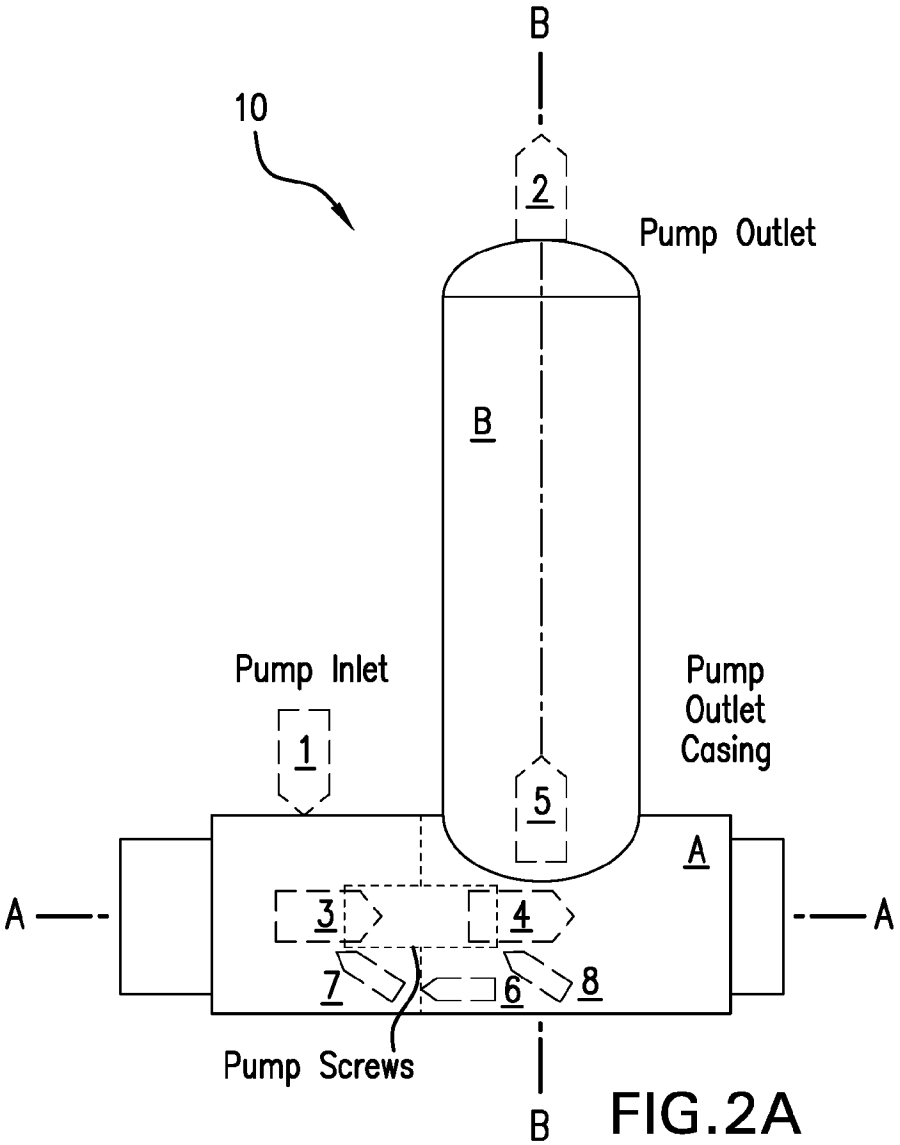

In some embodiments the orifices are integrated into the pump liner for better serviceability. Any desired number of orifices (e.g., one, two, four) can be provided for each screw to provide a desired recirculation flow. As shown in FIGS. 2A and 2B, the pump discharge casing (B) can be mounted directly on top of the pump body (A), and can extend orthogonally away from the pump body (A). As previously mentioned, in some embodiments the longitudinal axis "B-B" of the discharge casing can be oriented at an angle so that the longitudinal axis "B-B" of the discharge casing forms an angle of from 30-degrees to 90-degrees with respect to longitudinal axis "A-A" of the pump body (A).

Figure 3B:
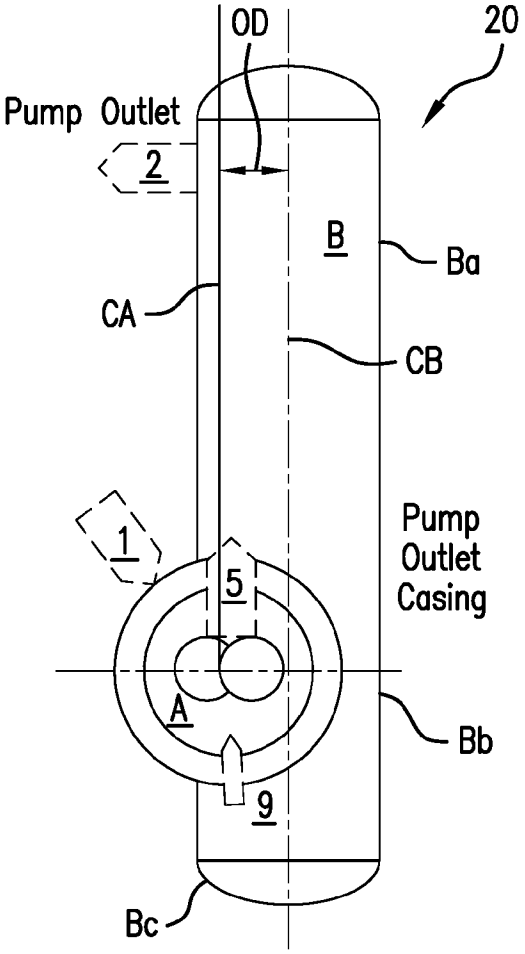
FIGS. 3A and 3B are side and end views of a second example embodiment of a multiphase pump arrangement in accordance with the present disclosure.
Figure 3A:
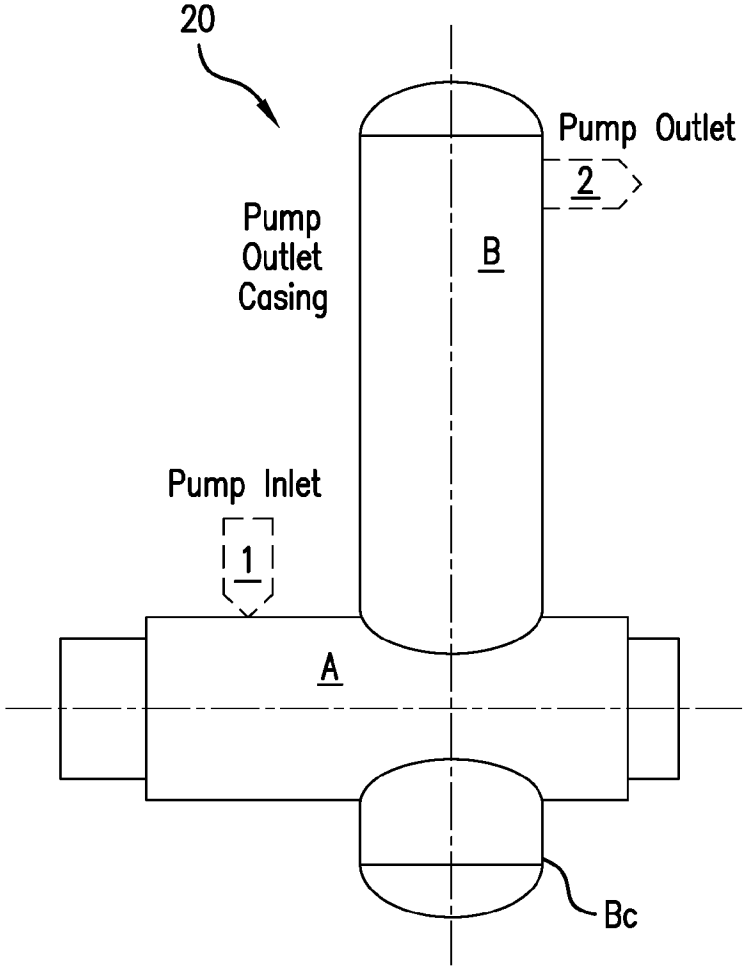

FIGS. 3A and 3B illustrate an embodiment of a pump 20 including all of the features of pump 10 discussed in relation to FIGS. 2A and 2B, except that the discharge casing (B) of pump 20 can include or surround a portion of the pump body (A). In the illustrate embodiment, pump 20 includes a discharge casing (B) that is oriented orthogonal to the pump body (A) (though it will be appreciated that the discharge casing (B) can be oriented at any appropriate non-zero angle with respect to the pump body). In the illustrated embodiment the discharge casing (B) includes an upper portion (Ba) positioned above the pump body (A), a lower portion (Bb) that is disposed adjacent to, and partially encloses, a side portion of the pump body (A), and a bottom portion (Bc) that is disposed below the pump body (A). In addition, the central axis "CB" of the discharge casing (B) is offset from the center "CA" of the pump body (A) by a distance "OD". This offset configuration can provide the best possible separation and liquid collection in the lower portion of the outlet casing. Also, the offset may be beneficial in that it can be required to install the inlet flange easily. Offset can be from 0 to ¾ of the pump casing diameter.

In a further embodiment, it is contemplated that two reduced-diameter outlet casings could be used in lieu of a single outlet casing where a small diameter outlet casing is beneficial.

Figure 4A:
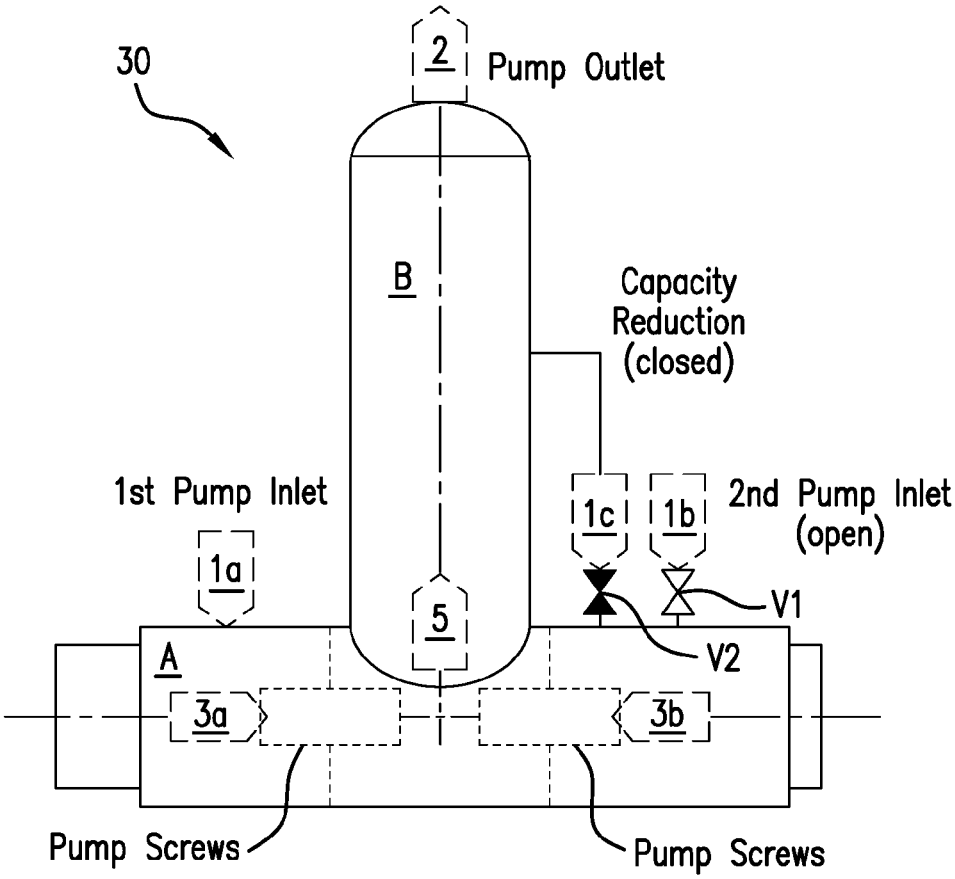
FIGS. 4A and 4B are side views of an example of a third embodiment of a multiphase pump arrangement in accordance with the present disclosure.
Figure 4B:
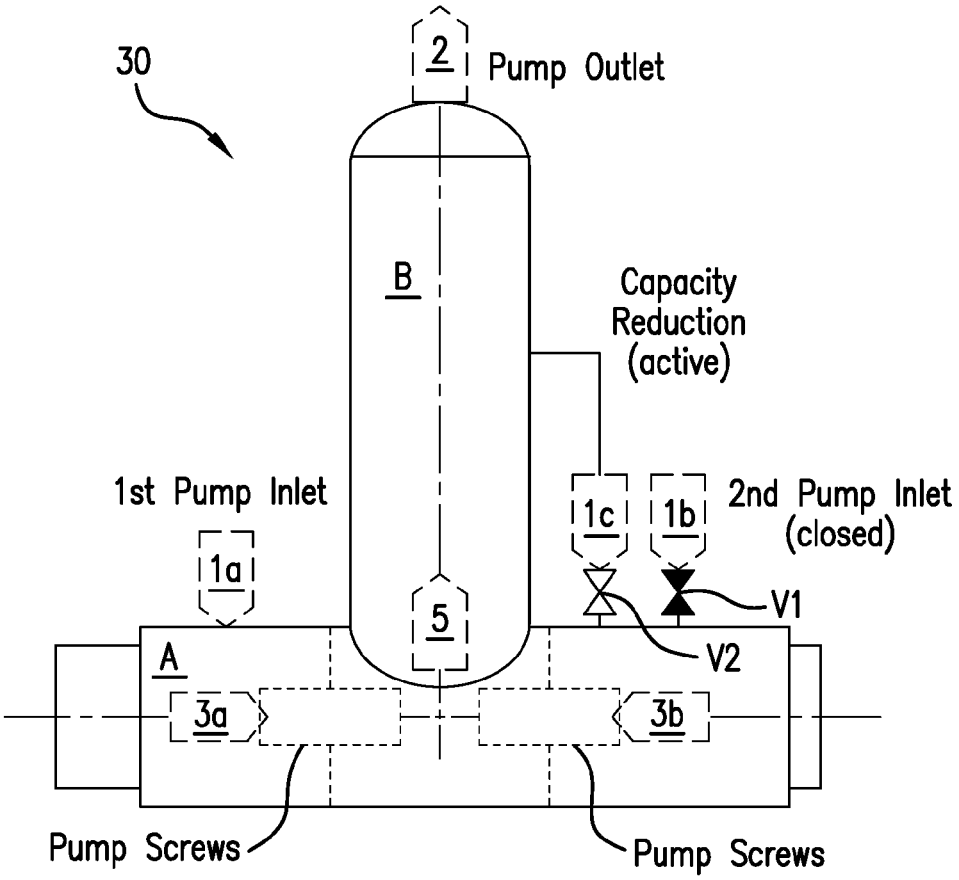

Referring now to FIGS. 4A and 4B, a flow reduction arrangement will be described in greater detail. Because of the constant flow characteristic of twin-screw-pumps, as is typical for all positive displacement pumps, flow reduction can be difficult when a speed control device is not used. With conventional arrangements, the only way to reduce flow is to recirculate a portion of the discharge fluid back to the pump suction, which undesirably wastes energy and adds heat to the process. The unique, full double inlet design of pump 30, which includes two separate inlets, allows the user to shut off only one inlet, and to fill this inlet chamber with fluid from the discharge casing. As seen, the pump 30 of this embodiment includes a main pump body (A) with a discharge casing (B) mounted to the top of the main pump body so that the discharge casing is oriented orthogonally with respect to the main pump body (again, and as mentioned in some embodiments the discharge casing can be provided at any appropriate non-zero angle with respect to the main pump body). First and second inlets (1*a*), (1*b*) are provided to inlet regions of first and second pump screw pairs (3*a*), (3*b*). The discharge regions of the first and second pump screw pairs (3*a*), (3*b*) converge so that discharge flow (5) is routed to the discharge casing (B). A third inlet (1*c*) provides a flow path from the discharge casing (B) to an inlet region of the second screw pair (3*b*). Isolation valves V1, V2 are provided for the second and third inlets (1*b*), (1*c*) to selectively enable/prevent flow through those inlets. It will be appreciated that V1 could be a check valve, and that V1 and V2 can be manually or actuator operated.

During normal operation, shown in FIG. 4A, the first inlet (1*a*) is always open, while the second inlet (1*b*) is open only when the pump is operating at full capacity. The second isolation valve V2 is closed preventing recirculation flow from the discharge casing (B) to the inlet chamber associated with the second screw pair (3*b*). The inlet chamber associated with the second pump inlet (1*b*) is thus filled with fluid at suction pressure and flow is provided to the first and second pump screw pairs (3*a*), (3*b*) at suction pressure. The pump boosts the flow via the first and second pump screw pairs (3*a*), (3*b*) and provides the boosted flow (5) to the discharge casing (B).

During reduced capacity operation, shown in FIG. 4B, the first inlet (1*a*) remains open, the second inlet (1*b*) is closed (i.e., the first isolation valve V1 is closed), and the third inlet (1*c*) is open (i.e., the second isolation valve V2 is open). As can be seen, the third inlet (1*c*) enables fluid to recirculate from the discharge casing (B) to the inlet chamber associated with second screw (3*b*). Because the inlet chamber associated with the second screw (3*b*) is connected to the discharge casing (B) the inlet chamber is filled with fluid at discharge pressure. The flow passing through the second screw pair (3*b*) need not be separately pressurized, and thus no hydraulic energy is required to move flow from the inlet to the outlet of the second screw pair. Only the flow from the first (open) inlet 1*a* is boosted to discharge pressure via the first screw pair (3*a*). In some embodiments, one or both valves can be partially open to enable a smooth capacity change or reduced capacity operation. In one example embodiment, V2 could be partially open.

Figure 5B:
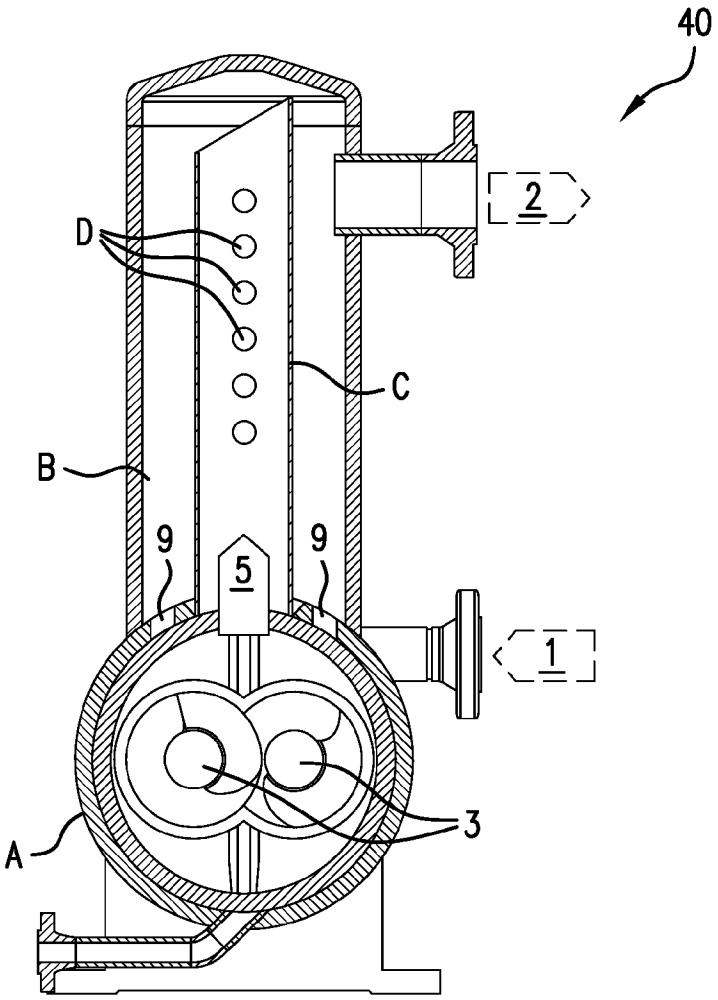
FIGS. 5A and 5B are perspective and cross-section views, respectively, of a fourth example embodiment of a multiphase pump arrangement in accordance with the present disclosure.
Figure 5A:
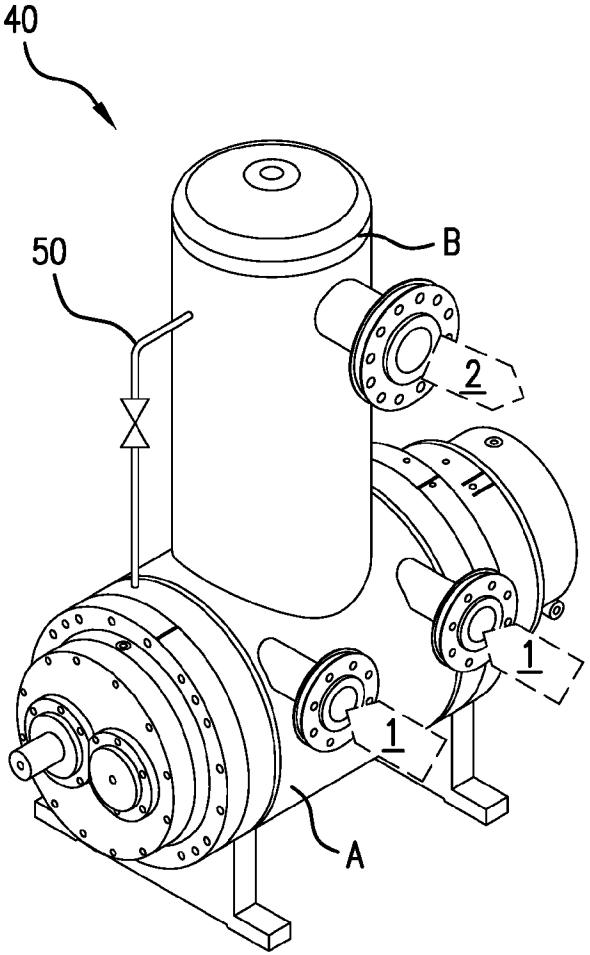

Referring now to FIGS. 5A and 5B, a multiphase pump 40 is shown with first and second inlets (1), a single discharge (2) and two sets of screws (3). The inlets (1) are positioned so that inlet flow is tangential to the screw pairs (3). As will be appreciated, it can be beneficial to use two inlet flanges per inlet compartment to feed each screw pair (3) separately.

A central discharge casing (B) extends orthogonally, vertically, from the horizontally oriented main pump body (A) so that fluid discharged by the screws (3) flows upward into the discharge casing (B) (though as mentioned, the central discharge casing (B) can be oriented at any appropriate non-zero angle with respect to the main pump body (A)). The illustrated embodiment includes an optional separation aid comprising a tubular element (C) disposed centrally within the discharge casing (B). The tubular element (C) is coupled at one end to the top of the main pump body (A) so that fluid discharged by the screws (3) enters the internal portion of the tubular element. The top end of the tubular element (C) is disposed below the top of the discharge casing (B) so that fluid flows up through the tubular element (C) and into the discharge casing. In some embodiments the tubular element (C) can include one or more openings (D) along the vertical length of the tubular element to enable fluid to pass from within the tubular element to the discharge casing (B) before the fluid reaches the top of the tubular element. In some embodiments, the tubular element (C) can include or be replaced by guide vanes to initiate a spin into the fluid for enhanced liquid separation.

In the illustrated embodiment, two liquid balancing holes (9) are disposed in an upper region of the main pump body to allow liquid to flow back from the discharge casing (B) to the discharge chamber portion of the main pump body (A) for high gas operation evolutions. The fluid which cannot be captured inside the pump discharge casing will leave the pump through the pump outlet (2). It will be appreciated that one or more liquid balancing holes can be used, and that in some embodiments more liquid balance holes (e.g., 4, 6) can be used.

The pump 40 can include a "capacity reduction line", which can be the same or similar to the capacity reduction arrangement described in relation to the embodiment of FIGS. 4A and 4B. As will be appreciated, the capacity reduction line allows the user to shut off one inlet and open it to discharge so that one set of screws runs idle without adding to pump capacity.

While the present disclosure refers to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. All rotational references describe relative movement between the various elements. Identification references (e.g., primary, secondary, first, second, third, fourth, etc.) are not intended to connote importance or priority but are used to distinguish one feature from another. The drawings are for purposes of illustration only and the dimensions, positions, order and relative to sizes reflected in the drawings attached hereto may vary.

What is claimed is:

1. A multiphase pump system, comprising:

a pump having first and second screw rotors disposed within a pump body, and at least one inlet in fluid communication with the first and second screw rotors, respectively; and a discharge casing mounted on top of, and extending vertically from, the pump body, the discharge casing being directly mechanically and fluidly connected to a top of the pump body so that the discharge casing directly receives fluid discharged from the first and second screw rotors, the discharge casing further having a longitudinal axis that is oriented at a non-zero angle with respect to a longitudinal axis of the pump body;

wherein the discharge casing comprises a separation chamber that facilitates separation of liquid and gas components of the fluid discharged from the first and second screw rotors, and wherein the pump body includes at least one opening disposed in a portion of the pump body that is directly coupled to the discharge casing to allow separated liquid to flow directly from the discharge casing to a discharge chamber of the pump body.

2. The multiphase pump system of claim 1, further comprising at least one orifice in a pump liner portion of the pump body to permit liquid to recirculate from the discharge casing to the at least one inlet.

3. The multiphase pump system of claim 1, wherein the discharge casing partially surrounds the pump body.

4. The multiphase pump system of claim 1, wherein a central axis of the discharge casing is offset from a center of the pump body.

5. The multiphase pump system of claim 1, wherein the at least one inlet is positioned to provide inlet flow tangential to the at least one set of screw rotors.

6. The multiphase pump system of claim 1, wherein the at least one inlet comprises a plurality of inlets.

7. The multiphase pump system of claim 1, wherein the first and second screw rotors form a set of rotors, and the pump body contains a plurality of the set of rotors.

8. The multiphase pump system of claim 1, further comprising a capacity reduction line disposed between the discharge casing and the pump body, the capacity reduction line configured to provide a flow of pressurized liquid from the discharge casing to an inlet chamber of the pump body.

9. The multiphase pump system of claim 8, further comprising a first isolation valve disposed in the capacity reduction line, and a second isolation valve disposed between the second inlet and the pump body.

10. The multiphase pump system of claim 1, further comprising a tubular separation element disposed within the discharge casing, the tubular separation element positioned to receive discharge flow from the pump body and to direct the received flow into the discharge chamber.

11. The multiphase pump system of claim 10, wherein the tubular separation element includes at least one opening along a length of the tubular separation element for directing the received flow into the discharge chamber through the opening.

* * * * *